US008308986B1

(12) United States Patent
Stuart

(10) Patent No.: US 8,308,986 B1
(45) Date of Patent: Nov. 13, 2012

(54) BISMUTH COMPOUNDS COMPOSITE

(76) Inventor: McCord Stuart, Westford, MA (US)

( * ) Notice: Subject to any disclaimer, the term of this patent is extended or adjusted under 35 U.S.C. 154(b) by 0 days.

(21) Appl. No.: 13/524,447

(22) Filed: Jun. 15, 2012

Related U.S. Application Data

(60) Continuation of application No. 12/814,643, filed on Jun. 14, 2010, which is a continuation-in-part of application No. 12/380,107, filed on Feb. 23, 2009, now abandoned, which is a division of application No. 10/850,930, filed on May 22, 2004, now abandoned.

(51) Int. Cl.
*G21F 1/08* (2006.01)
*G21F 1/10* (2006.01)
*G21C 7/24* (2006.01)

(52) U.S. Cl. ..... 252/478; 250/492.1; 250/492.3; 250/505.1; 250/515.1; 250/516.1

(58) Field of Classification Search ..... 250/492.21, 250/492.3, 505.1, 515.1, 516.1; 252/478
See application file for complete search history.

(56) References Cited

U.S. PATENT DOCUMENTS

| | | | | |
|---|---|---|---|---|
| 4,485,838 | A | 12/1984 | Shoji et al. | |
| 4,619,963 | A | 10/1986 | Shoji et al. | |
| 4,728,844 | A | 3/1988 | Wilson et al. | |
| 4,957,943 | A | 9/1990 | McAllister et al. | |
| 5,059,807 | A * | 10/1991 | Kersten et al. | 250/519.1 |
| 5,190,990 | A | 3/1993 | Eichmiller | |
| 5,360,666 | A | 11/1994 | Eichmiller | |
| 5,548,125 | A | 8/1996 | Sandbank | |
| 5,550,383 | A | 8/1996 | Haskell | |
| 5,665,808 | A | 9/1997 | Bilsbury | |
| 5,719,352 | A | 2/1998 | Griffen | |
| 5,730,664 | A | 3/1998 | Asakura et al. | |
| 6,048,379 | A | 4/2000 | Bray et al. | |
| 6,166,390 | A | 12/2000 | Quapp et al. | |
| 6,310,355 | B1 | 10/2001 | Cadwalader | |
| 6,740,260 | B2 * | 5/2004 | McCord | 252/511 |
| 7,379,529 | B2 | 5/2008 | Mattson et al. | |
| 7,638,783 | B2 * | 12/2009 | McCord | 250/515.1 |
| 2002/0148980 | A1 * | 10/2002 | Cadwalader et al. | 250/515.1 |
| 2003/0918142 | | 5/2003 | Murakami | |
| 2004/0077919 | A1 * | 4/2004 | Drobnik et al. | 600/3 |
| 2004/0124374 | A1 * | 7/2004 | Joseph | 250/507.1 |
| 2005/0018817 | A1 | 1/2005 | Oettinger et al. | |
| 2005/0258404 | A1 * | 11/2005 | McCord | 252/582 |
| 2007/0145294 | A1 * | 6/2007 | McCord | 250/474.1 |

* cited by examiner

*Primary Examiner* — Joseph D Anthony
(74) *Attorney, Agent, or Firm* — Marian J. Furst; Craig W. Barber

(57) ABSTRACT

A heavily filled bismuth compound composite having a polymer matrix and a bismuth compound therein. The bismuth compound may be bismuth oxide, or other bismuth compounds. The polymer may be any of a very wide range of materials or combinations thereof. Binder, secondary fillers or other third components may be added. By means of use of various bismuth compounds, polymers, and third components, the physical, radiological and electrical properties of the finished products may be tailored to achieve desired properties. In addition, the invention teaches that radiation shielding, insulators, and combined radiation shield/insulators may be fashioned from the composite. A wide range of production methods may be employed, including but not limited to liquid resin casting.

22 Claims, 2 Drawing Sheets

BISMUTH COMPOUNDS COMPOSITE

CROSS REFERENCE TO RELATED APPLICATIONS

This application is a continuation of copending U.S. application Ser. No. 12/814,643, filed on Jun. 14, 2010, in the name of the same inventor and having the same title, which is a CIP of U.S. application Ser. No. 12/380,107, filed on Feb. 23, 2009, in the name of the same inventor and having the same title, now abandoned, which is a divisional of U.S. patent application Ser. No. 10/850,930 filed on May 22, 2004 in the name of the same inventor and having the same title, now abandoned, the entire disclosures of which are incorporated herein by this reference.

FIELD OF THE INVENTION

This invention relates to generally to polymer-metal-precursor composites and particularly to a polymer-metal-precursor composite in which the metal-precursor component is bismuth oxide.

BACKGROUND OF THE INVENTION

X-ray and gamma ray sources are presently being used in a wide array of medical and industrial machinery, and the breadth of such use expands from year to year. Consumers tend to notice medical and dental X-ray machines, but in addition to these applications there are baggage screening machines, CAT scan machines, non-destructive industrial inspection machinery and ion implantation machines used in the manufacture of silicon wafer computer chips. All require that radiation be contained and directed. In particular, the ion implantation machinery increased in the 1980s and 1990's with the silicon chip boom.

In the past, lead itself or lead-polymer composites were used to make such items. But there are numerous problems with the use of lead. One problem with lead is that it is toxic and thus subject to increasingly stringent legal controls. Another issue is that lead may not have the mechanical or electrical properties desired for a given application. Lead has been used in various forms in wide range of applications: machined, as a solid casting, as a solid encased within a matrix such as a polymer matrix, or as a filler. As a filler, it may be lead particles, tribasic lead-sulfate or lead-oxide particles or particles of a specified shape or size, or as a mixture with other materials such as tin. Tungsten shielding, or polymer-tungsten shielding has also been used. Examples of all of these methods may be found in the prior art.

Polymer-metal composite materials are of increasing importance in radiation technology and a number of industries, due to the fact that polymer-metal composite materials offer characteristics which are difficult or impossible to match in other materials of equivalent price or ease of manufacture.

In general, polymer-metal composites are materials having a polymer matrix containing particles of a metal compound intermixed therein. The polymer may advantageously have plastic properties allowing for ease of manufacture, but a wide variety of polymers are known for use in such composites. The choice of metal will place undesirable limitations on the range of properties which may be provided to the manufactured composite. In general, high density and accompanying factors such as increased mass, increased radiological shielding properties, heat-deflection properties, impact strength, tensile strength and so on. In the prior art, lead has been a particularly favored material for its density and ease of working. Tungsten has been favored more recently, despite cost concerns. Three characteristics in particular which make such materials desirable are electrical non-conductivity, radiological shielding ability, and high density.

There is a growing list of applications for which polymer-metal composite materials are either required or advantageous. Reactor shielding, ion implantation machine source insulators, X-ray tube housings, radioisotope housings, syringe housings, body shielding, dental X-ray packets ("bitewings"), containers, other castings and housings all benefit from the properties of polymer-metal composite materials. In the case of typical high voltage insulators for ion implantation machinery, a thick walled generally round or cylindrical part is created out of lead or polymer-lead-oxide ranging from an inch to several feet or more in long dimension and weighing anywhere up to 500 pounds. Wall thickness may range from ½ inch to several inches. Such parts must resist high voltages, shield against x-ray or gamma ray emission and hold a high vacuum state when connected to the vacuum chamber. X-ray tube shielding is generally thinner (often 0.070 inch thickness), generally smaller, and of different shape, having an aperture for the X-ray beam, but once again must offer high voltage insulation and radiation protection. The lead in such devices obviously presents an environmental challenge to manufacture, use and disposal.

In the processing of lead precursor filled plastics known in the art, specialized facilities, handling procedures, training and safety equipment must be used to protect the employees from the lead precursor they handle. Lead-based dust is a particular concern, being airborne and inhalable. Such dust may be generated during mixing, molding, deflashing, machining and finishing of final products such as insulators or shields, to say nothing of earlier stages of mining, smelting and refining of lead and the final disposal of the used product at the end of its useful life. Even during the life span of the product, it is illegal to sand, machine, alter or use the product in any way that will generate dust. All such processes must be carried out at special lead handling sites, and all waste dust from any of these processes must be collected in accordance with OSHA regulations and transported to hazardous waste land fills in accordance with OSHA and DES guidelines.

Internalized by law into the manufacturing process, such safety issues dramatically increase the cost of such products, which in turn increases other medical or industrial costs.

One recent invention to deal with this issue is TUNGSTEN-PRECURSOR COMPOSITE, for which application Ser. No. 10/095,350 was filed Mar. 9, 2002, in the name of the same inventor, Stuart J. McCord, and issued on May 6, 2004, as U.S. Pat. No. 6,740,260. This invention addresses material and cost concerns of tungsten shielding by proposing the use of tungsten precursor materials which testing reveals to have favorable properties. However, an entire range of desirable properties is not attainable with a single family of compounds, and so additional compounds may be desirable in order to expand the range of properties which may be attained in a lead-free shield device. Cost, of course, is one issue. Availability is another, as are actual material properties. During prosecution of that patent, U.S. Pat. No. 5,548,125 issued to Sandback (RADIATION PROTECTIVE GLOVE) and U.S. Pat. No. 4,957,943 issued to McAllister et al (PARTICLE-FILLED MICROPOROUS MATERIALS) were cited by the examiner prior to allowance. Another attempt to deal with the issue of environmental lead contamination may be found in U.S. Pat. No. 6,048,379 issued Apr. 11, 2000, to Bray et al for "HIGH DENSITY COMPOSITE MATERIAL." This patent teaches the use of tungsten powder, a binder and a polymer to provide a composite material offering a density high enough for use as ammunition. As stated, a serious issue with the use of tungsten is that of cost. Tungsten metal is quite expensive in comparison to lead. For example, tungsten-composite materials may cost as much as $20 per pound.

U.S. Pat. No. 5,730,664, U.S. Pat. No. 5,719,352, and U.S. Pat. No. 5,665,808, respectively issued to Asakura, Griffin, Bilsbury all disclose metal-polymer composites for projectiles, respectively golf balls and shot pellets. Other patents from the same art (projectiles) also propose non-toxic materials.

In the actual radiation shielding art itself, various patents propose polymer-metal composites of various forms.

EcoMASS (a registered trademark of the PolyOne Corporation) is a combination of tungsten metal and nylon and elastomer compounds used for shielding, apparently based upon the Bray '379 patent related to ammunition and thus developed specifically in response to military/sporting needs for non-toxic ammunition. It does not teach that materials other than tungsten may be used, thus limiting the range of characteristics of the final product. For example, tungsten is electrically conductive and thus is not normally suitable for insulators. As mentioned earlier, this material also faces cost limitations. In addition, this material has manufacturing limitations in terms of thickness and size of the final item.

U.S. Pat. No. 4,619,963 issued Oct. 28, 1986, to Shoji et al for "RADIATION SHIELDING COMPOSITE SHEET MATERIAL" teaches a lead-tin fiber and resin shield, as does U.S. Pat. No. 4,485,838 issued Dec. 4, 1984, to the same inventors.

U.S. Pat. No. 6,310,355 issued Oct. 30, 2001, to Cadwalader for "LIGHTWEIGHT RADIATION SHIELD SYSTEM" teaches a flexible matrix having a radiation attenuating material and at least one void.

U.S. Pat. No. 6,166,390 issued Dec. 26, 2000, to Quapp et al for "RADIATION 10 SHIELDING COMPOSITION" teaches a concrete composite material.

U.S. Pat. No. 5,360,666 issued Nov. 1, 1994, and U.S. Pat. No. 5,190,990 issued Mar. 2, 1993, to Eichmiller for "DEVICE AND METHOD FOR SHIELDING HEALTHY TISSUE DURING RADIATION THERAPY" teach a radiation shield for the human body comprising an elastomeric material and certain mixtures (see the summary of the invention) of various metals in the form of spherical particles.

Bismuth is one of the least electrically and thermally conductive metals, and in non-radiological applications, it has been known as a substitute for lead. For example, in glazes and surface treatments bismuth is known to provide high gloss, similar surface material properties, viscosity and resistance to detergents (dishwasher detergents). In optical work, bismuth oxide is known to be useful in replacing lead (in amounts of 50% or less) so as to increase specific gravity, refractive index and durability of the optical equipment.

The safety of bismuth oxide may be understood from the fact that it is commonly used in internal prosthesis (bone replacement), in order to create a "radiologically opaque" or "X-ray opaque" part. Such items show up on an X-ray at the low power of radiation which a patient receives, thus marking the location and structure of the prosthetic appliance which has been physically implanted in the body of the recipient.

However, bismuth is not generally known in the radiological field as an X-ray resistant shielding material.

SUMMARY OF THE INVENTION

General Summary

The present invention teaches a novel family of lead-free plastic materials that may act as replacements for lead or lead oxide filled plastics, particularly in the role of radiation shields and insulators. The present invention teaches a heavily filled polymer-bismuth composite comprising a plastic matrix. As used herein, the term "heavily filled" means that the composite comprises a minimum of about 66% bismuth materials by weight within it as "filler." The properties of heavily filled bismuth compounds are favorable for a number of reasons.

The range of available bismuth compounds adds even more to this highly desirable flexibility. Designers of radiological equipment often have to contend with a variety of conflicting design criteria: thickness in one location, strength in another, degree of shielding in yet another. Providing a maximum range of thermal, electrical, radiological and physical characteristics is thus highly desirable.

The flexibility added by means of the use of this new material allows a wider range of function and use when compared with previous methods using a single metal, lead, or a lead and polymer composite.

The present invention further teaches the use of binders, fibers, and secondary fillers in the polymer-bismuth composite in order to further broaden the range of achievable desirable physical, radiological and/or electrical properties.

Summary in Reference to Claims

It is therefore one aspect, advantage, objective and embodiment of the present invention to provide a radiation shielding and electrically insulating rigid structure, the structure comprising:

a heavily filled material comprising:

a polymer matrix; and at least about 66 percent by weight of a bismuth compound within the polymer matrix, wherein the bismuth compound comprises at least one member selected from the following group: bismuth oxide, bismuth aluminate, bismuth citrate, bismuth hydroxide, bismuth subgallate, bismuth subsalicylate, bismuth hydrate, bismuth subcarbonate, bismuth oxychloride, and combinations thereof;

wherein the structure has a thickness of at least about 0.25 inches.

It is therefore another aspect, advantage, objective and embodiment of the present invention to provide a rigid structure, wherein the bismuth compound is present in an amount of at least about 70 percent by weight.

It is therefore another aspect, advantage, objective and embodiment of the present invention to provide a rigid structure, wherein the bismuth compound is present in an amount of at least about 75 percent by weight.

It is therefore another aspect, advantage, objective and embodiment of the present invention to provide a rigid structure, wherein the material has properties selected from the following group: electromagnetic, alpha, and beta radiation shielding capability of the same order of magnitude as lead oxide filled epoxy; a dielectric strength greater than about 200 volts/mil; an arc resistance greater than about 100 seconds; a low thermal conductivity; and combinations thereof.

It is therefore another aspect, advantage, objective and embodiment of the present invention to provide a rigid structure, wherein the polymer matrix comprises at least one member selected from the following group: thermosetting materials, thermoplastic materials, and combinations thereof.

It is therefore another aspect, advantage, objective and embodiment of the present invention to provide a rigid structure, wherein the polymer matrix comprises at least one member selected from the following group: epoxy, polyester, polyurethane, silicone rubber, bismaleimides, polyimides, vinylesters, urethane hybrids, polyurea elastomer, phenolics, cyanates, cellulose, fluoro-polymer, ethylene inter-polymer alloy elastomer, ethylene vinyl acetate, nylon, polyetherimide, polyester elastomer, polyester sulfone, polyphenyl amide, polypropylene, polyvinylidene flouride, acrylic, homopolymers, acetates, copolymers, acrylonitrile-butadiene-styrene, fluoropolymers, ionimers, polyamides, polyamide-imides, polyacrylates, polyether ketones, polyaryl-sulfones, polybenzimidazoles, polycarbonates, polybutylene, terephthalates, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, allyls, aminos, polyphenylene oxide, and combinations thereof.

It is therefore another aspect, advantage, objective and embodiment of the present invention to provide a rigid structure, further comprising a third material.

It is therefore another aspect, advantage, objective and embodiment of the present invention to provide a rigid structure, wherein the third material comprises at least one member selected from the following group: electrically insulating materials, binders, high density materials, and combinations thereof.

It is therefore another aspect, advantage, objective and embodiment of the present invention to provide a rigid structure, wherein the third material comprises at least one member selected from the following group: tungsten metal, other metals, calcium carbonate, hydrated alumina, tabular alumina, silica, glass beads, glass fibers, magnesium oxide/sulfate, wollastonite, stainless steel fibers, copper, carbonyl iron, iron, molybdenum, nickel, and combinations thereof.

It is therefore another aspect, advantage, objective and embodiment of the present invention to provide a rigid structure, wherein the third material comprises barium sulfate within the polymer matrix.

It is therefore another aspect, advantage, objective and embodiment of the present invention to provide a rigid structure, wherein the third material comprises an amount by volume approximately ranging from about 5 percent to about 65 percent of the total composite volume.

It is therefore another aspect, advantage, objective and embodiment of the present invention to provide a rigid structure, wherein the third material comprises an amount by volume approximately ranging from about 10 percent to about 30 percent of the total composite volume.

It is therefore another aspect, advantage, objective and embodiment of the present invention to provide a rigid structure, wherein the bismuth compound comprises bismuth oxide in an amount of at least about 66 percent by weight of the material.

It is therefore another aspect, advantage, objective and embodiment of the present invention to provide a rigid structure, wherein the bismuth compound comprises bismuth oxide in an amount of at least about 80 percent by weight of the material.

It is therefore another aspect, advantage, objective and embodiment of the present invention to provide a rigid structure, comprising:

a radiation shield box having a first truncated cone section and a second truncated cone section secured together at their respective bases by an overlap joint so as form a hollow structure, the first and second truncated cone sections having walls.

It is therefore another aspect, advantage, objective and embodiment of the present invention to provide a rigid structure, wherein the radiation shield box further comprises an X-ray tube disposed within the hollow structure, at least one electrical port passing through the wall, and at least one oil port passing through the walls.

It is therefore another aspect, advantage, objective and embodiment of the present invention to provide a rigid structure, wherein the structure comprises a high voltage electrical insulator for an ion source, the insulator comprising a generally annular shaped structure having at least one vacuum sealing surface dimensioned and configured to provide a tight seal.

It is therefore another aspect, advantage, objective and embodiment of the present invention to provide a rigid structure, wherein the high voltage electrical insulator further comprises an element selected from at an alignment pin projecting from the insulator, a metal insert secured to the structure; and combinations thereof.

It is therefore another aspect, advantage, objective and embodiment of the present invention to provide a rigid structure, wherein the high voltage electrical insulator for an ion source, further comprises barium sulfate within the polymer matrix.

It is therefore another aspect, advantage, objective and embodiment of the present invention to provide a rigid structure, wherein the polymer matrix of the high voltage electrical insulator comprises Novolac and at least about 10 percent by volume of hydrated alumina.

It is therefore another aspect, advantage, objective and embodiment of the present invention to provide a rigid structure, wherein the high voltage electrical insulator further comprises at least about 16 percent hydrated alumina by volume within the matrix.

It is therefore another aspect, advantage, objective and embodiment of the present invention to provide a rigid structure, wherein the electrical insulator further comprises barium sulfate within the polymer matrix.

It is another aspect, advantage, objective and embodiment of the present invention to provide a method of making a radiation shielding and electrically insulating rigid structure, the method comprising the steps of:

a) combining a bismuth compound and a polymer into a composite wherein the bismuth compound comprises at least one member selected from the following group: bismuth oxide, bismuth aluminate, bismuth citrate, bismuth hydroxide, bismuth subgallate, bismuth subsalicylate, bismuth hydrate, bismuth oxychloride, bismuth subcarbonate, and combinations thereof, in an amount of at least about 66 percent by weight; and b) forming the composite into a desired shape having a thickness of at least about 0.25 inches;

wherein:

the material has electromagnetic, alpha, and beta radiation shielding capability of the same order of magnitude as lead oxide; dielectric strength greater than about 200 volts/mil; arc resistance greater than about 100 seconds; and low thermal conductivity.

It is therefore another aspect, advantage, objective and embodiment of the present invention to provide a method of making a radiation shielding and electrically insulating rigid structure, wherein the step of forming the composite into the desired shape further comprises one member selected from the following group: casting, molding, machining, extrusion, aggregation, liquid resin casting, injection molding, compression molding, transfer molding, pultrusion, centrifugal molding, calerendering, filament winding, and combinations thereof. method of making a radiation shielding and electrically insulating rigid structure, wherein the polymer comprises at least one member selected from the following group:

epoxy, polyester, polyurethane, silicone rubber, bismaleimides, polyimides, vinylesters, urethane hybrids, polyurea elastomer, phenolics, cyanates, cellulose, fluoro-polymer, ethylene inter-polymer alloy elastomer, ethylene vinyl acetate, nylon, polyetherimide, polyester elastomer, polyester sulfone, polyphenyl amide, polypropylene, polyvinylidene flouride, acrylic, homopolymers, acetates, copolymers, acrylonitrile-butadiene-styrene, fluoropolymers, ionimers, polyamides, polyamide-imides, polyacrylates, polyether ketones, polyaryl-sulfones, polybenzimidazoles, polycarbonates, polybutylene, terephthalates, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, allyls, aminos, polyphenylene oxide, and combinations thereof.

It is therefore another aspect, advantage, objective and embodiment of the present invention to provide a method of making a radiation shielding and electrically insulating rigid structure, wherein the bismuth compound is present in an amount of at least about 70 percent by weight.

It is therefore another aspect, advantage, objective and embodiment of the present invention to provide a method of making a radiation shielding and electrically insulating rigid structure, wherein the bismuth compound is present in an amount of at least about 75 percent by weight.

BRIEF DESCRIPTION OF THE DRAWINGS

These and other features, aspects, and advantages of the present invention will become better understood with reference to the following description, appended claims, and accompanying drawings, where:

DETAILED DESCRIPTION

Figure 1:
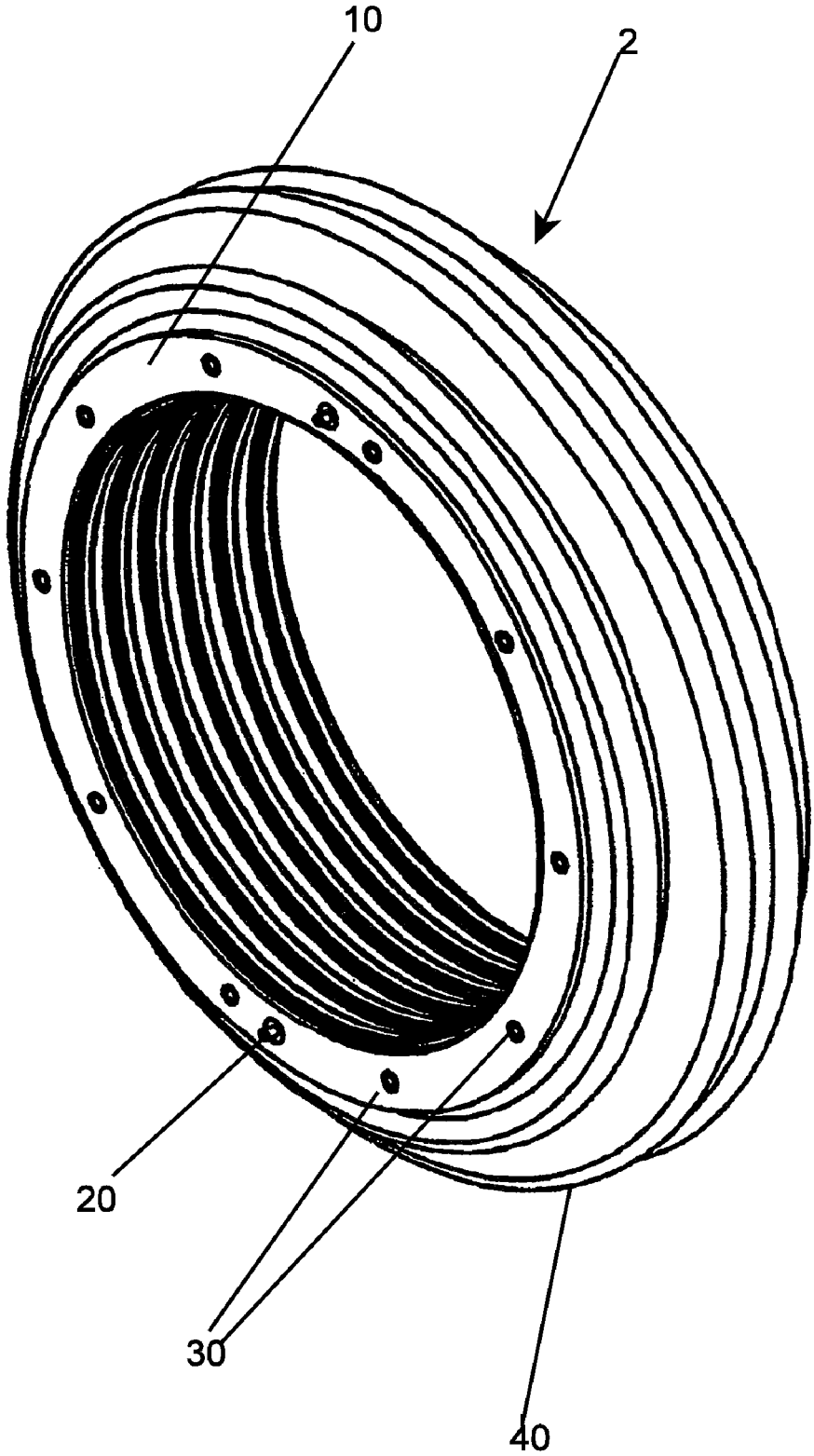
FIG. 1 is a perspective view of a first embodiment of an ion source insulator according to the present invention.

The present invention teaches a novel family of lead-free plastic materials that may act as replacements for lead or lead oxide filled plastics, particularly in the role of radiation shields and insulators. The presently preferred embodiment and best mode presently contemplated of the invention teaches a heavily filled polymer-bismuth composite comprising a plastic matrix having 66% by weight minimum bismuth precursors within it as filler. By bismuth precursors are meant materials such as bismuth oxide ($Bi_20_3$), but also including a broad range of members of the bismuth family of compounds specifically including bismuth aluminate ($Bi_2(Al_20_4)_3.10H_2O$), bismuth citrate ($C_6H_8O_7Bi$), bismuth hydroxide ($Bi(OH)_3$), bismuth subgallate ($C_7H_7O_7Bi$), bismuth subsalicylate ($C_7H_5O_4Bi$), bismuth hydrate, and combinations thereof.

Additional forms of bismuth which may be utilized in presently less favored embodiments include bismuth fluoride, bismuth iodide, bismuth oxychloride, bismuth oxynitrate, bismuth nitrate, bismuth pentahydrate, bismuth nitrate pentahydrate, bismuth subcarbonate and combinations thereof and in combinations with the more favored forms.

Bismuth, average atomic mass approximately 208.98, is usually reduced from the ore to form bismuth oxide prior to extraction as metal. For this reason, bismuth oxide is a relatively less expensive form of bismuth. For certain embodiments, bismuth oxide may be favored for this reason. Bismuth oxide ($Bi_20_3$, also bismuth trioxide) is thus used commonly herein, but the term should be understood to include all of the forms discussed in the previous paragraphs.

Bismuth metal itself, though not subject of the present invention, has certain interesting properties: it has the lowest electrical conductivity of any metal, and the second lowest thermal conductivity of any metal. The various forms of the metal of course have a considerable variation, and thus a highly desirable range of, properties which vary from that of the pure metal in ways both inimical and beneficial. However, bismuth metal itself is in fact an electrical conductor and thus undesirable for insulator applications as presented herein.

By teaching the use of a range of bismuth compounds instead of a single metal such as lead, or a single metal-polymer combination, the breadth of the properties which may be achieved is increased, another benefit of the invention. In particular, when compared to lead-composites:

a) Bismuth oxide consists of a combination of the bismuth atom and oxygen, having properties such as low conductivity (thermal and electrical), an average molecular weight of approximately 465.96 and a specific gravity of approximately 8.9 grams per cubic centimeter. It is generally not flammable and non-reactive, both safety benefits in the radiological laboratory, and is considered to be one of the least toxic of the heavy metals. (Bismuth metal itself has a density of approximately 9.8 grams per cubic centimeter.)

b) Bismuth oxide offers commercial advantages over tungsten metal. For example, bismuth oxide may cost only \$6.00/lb. This cost is higher than lead oxide (roughly \$1.00/lb) but is only a fraction of the cost of the final product. That is, a tungsten-composite may cost \$20 per pound to manufacture, so a bismuth oxide composite may be cheaper to manufacture. Manufacturing costs in relation to lead oxide itself may well be advantageous, as the bismuth oxide composite requires no special handling procedures, no toxic or hazardous waste disposal problems, and so on. The net result is that commercially useful manufacturing runs may occur at costs almost equal to that of lead oxide.

c) Bismuth offers environmental advantages over lead composites. While lead causes adverse consequences after ingestion, ingestion of most bismuth compounds does not. While lead is subject to very stringent regulations as laid out in the BACKGROUND OF THE INVENTION, bismuth compounds in general are subject to looser regulation. Thus, the initial manufacturing and later repair and disposal costs are not only comparable, but the environmental impact is greatly reduced.

d) Bismuth oxide has the same density as lead oxide and thus can directly replace lead oxide in certain types of applications, at a 1:1 ratio. This factor offers interesting possibilities in the manufacturing arena, in particular, the chance to use lead oxide molds or copies or quick adaptations thereof without the need for significant retooling costs.

The present invention may be manufactured with thermosetting materials and/or thermoplastic materials.

The polymers, plastics and resins which may be advantageously employed in the present invention are too numerous for a complete list, however, a partial and exemplary list includes epoxy, polyester, polyurethane, silicone rubber, bismaleimides, polyimides, vinylesters, urethane hybrids, polyurea elastomer, phenolics, cyanates, cellulose, fluoro-polymer, ethylene inter-polymer alloy elastomer, ethylene vinyl acetate, nylon, polyetherimide, polyester elastomer, polyester sulfone, polyphenyl amide, polypropylene, polyvinylidene flouride, acrylic, homopolymers, acetates, copolymers, acrylonitrile-butadiene-styrene, fluoropolymers, ionimers, polyamides, polyamide-imides, polyacrylates, polyether ketones, polyaryl-sulfones, polybenzimidazoles, polycarbonates, polybutylene, terephthalates, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, allyls, aminos, and polyphenylene oxide. Numerous variations and equivalents are possible.

The invention is not limited to a single matrix component and a single bismuth composite, on the contrary multiple components may be included, for example, copolymers may be used or other mixtures of matrix elements. As another example, in tailoring of the physical properties of the composition, a blend of more than one bismuth compound (such as a blend of bismuth aluminate and bismuth oxide) may be used.

In addition, the invention supports addition to the mixture of secondary fillers, binders, fibers and other components. As examples, electrically insulating materials, strengthening materials, materials to provide a uniform composition or bind other components, and/or density increasing materials may be used. A more specific list of examples includes such materials as barium sulfate, tungsten, lead, other metals, calcium carbonate, hydrated alumina, tabular alumina, silica, glass beads, glass fibers, magnesium oxide, wollastonite, stainless steel fibers, copper, carbonyl iron, steel, iron, molybdenum, and/or nickel.

Barium sulfate ($BaSO_4$) in particular has been noted to be a material which may be beneficial in combination with bismuth compounds. Barium sulfate, being non-toxic and having properties which vary widely from those of the bismuth family (for example, the radiological properties are quite different) allows a much greater variation at a relatively lower cost.

In addition, the composite material of the present invention is susceptible to a wide range of processing methods both for creation of the material and creation of items incorporating the material. Casting, molding, aggregation, machining, liquid resin casting, transfer molding, injection molding, compression molding, extrusion, pultrusion, centrifugal molding, calendering, filament winding, and other methods of handling are possible. Additionally, the composite of the invention may advantageously be worked with known equipment such as molds and machine tools, thus avoiding costs associated with re-equipping production facilities. Furthermore, since the material contains no lead, significant cost and time savings may be realized and burdensome regulations regarding lead may be properly avoided during these processes.

In theory, the material may be substituted for lead shielding on a basis of approximately 1 to 1. Thus, for typical lead shielding of 0.070 inches thickness, a replacement may be manufactured of 0.070 inches thickness. For certain types of manufacture, this one for one substitution may allow use of lead composite molds to impress bismuth composite items.

High voltage electrical insulators (such as those on ion beam implantation devices or other ion beam sources, i.e. insulators which also serve as radiation shields) are typically bulky, which leads to excessive weight. Reducing the amount of metal in such metal-composites tends to lead to uneven distribution of the shielding component within the overall matrix of polymer. However, the present invention helps to solve this problem also.

Example I

A first formulation and embodiment of the invention was derived from bismuth oxide ($Bi_20_3$). The formulation comprised an epoxy resin (438 Novolac/HHPA curative, a trademark and product of the Dow Corporation), bismuth oxide (catalog no. RS-2299) and hydrated alumina. Volumetric percentages will be discussed below. 12 inch rigid square plates of 0.25 inch thickness were vacuum cast and examined. Test panels were machined from the plates.

The cast plate was of good quality.

The grain size was generally smaller than that of a lead oxide test item.

Machined panels were of good quality.

Material density was comparable to a lead oxide test item.

Shielding effectiveness was comparable to lead oxide test items.

Arc resistance was 125 seconds (Tested using ASTM D-495)

Dielectric Strength was 215 volts/mils (Tested using ASTM D-149)

Unexpectedly, grain density was smaller than the same density of lead oxide filled epoxy, thus allowing the potential for easy and inexpensive increases in volumetric percentage of filler material. For example, the industrial standard for most insulator applications is 35% lead oxide filler. However, the notably smaller grain size which has been experimentally noted by the inventor allows an increase in volumetric percentage of filler material without significant manufacturing alterations. Thus, contrary to expectations, it is possible to generate a bismuth oxide composite with a 50% by volume fill ratio (89% by weight), in turn increasing X-ray resistance by approximately 50%. The advantages of such an increase in efficiency combined with a simultaneous elimination of the necessity of lead or other hazardous material handling regulations are too obvious to belabor.

It may be seen that the arc resistance is also superior to lead epoxy composites (125 seconds versus 65 seconds). This value is important in insulators as increased ability to withstand surface damage from arcing leads to a reduction in surface carbon paths. In manufacturing, this requires that the device be shut down (stopping micro-chip production) and the replacing of the surface damaged part. Thus parts made with the invention last longer on average between failures/shutdowns (MTBF), thus increasing the utility of devices in which they are installed.

Dielectric strength was lower than a lead filled epoxy having the same density and X-ray shielding capacity (215 v/mil versus 300 volts/mil) but the difference was small enough that the material remains valuable for the intended applications.

In summary of the test results, it can be seen that for applications requiring high resistivity and high arc resistance, bismuth oxide composites may be advantageously used to achieve the desired properties. More importantly however, testing reveals that handling regulations are eased by the use of this safer material while retooling and redesign costs are minimized. Further, a small grain size may allow an actual increase in shielding efficiency. While the above described single test utilized epoxy resin, the present invention is not so limited, neither to the specific epoxy resin used nor to epoxy resin in general.

One example of an application of the composite is presented below, that of an ion implantation device source insulator, though the invention is not so limited.

It can also be seen that for applications requiring high shielding ability (such as X-ray source shieldingin the medical field), the invention may be formulated to provide a shielding ability sufficient for low cost and convenient lead replacement.

Without undue experimentation higher density formulations may be produced on demand by mixing additional secondary fillers into the composition. Alternatively, the bismuth oxide volumetric percentage may be increased by use of injection molding, compression molding or transfer molding. Such increases, when combined with the increases due to notably smaller bismuth oxide/polymer composite granularity, may allow quite significant additional shielding efficiencies to be realized at fairly low cost. As demonstrated by the example using hydrated alumina, other properties such as electrical resistivity/conductivity, workability, ductility, density, and so on may also be adjusted by use of secondary fillers, binders, and other agents in the composition.

Thus it is apparent that a wide variety of products may be produced, as the characteristics of the bismuth oxide composite of the present invention may be tailored depending upon the desired end characteristics. In addition, the environmental contamination engendered by the product is of a different order of magnitude than that produced by products containing lead.

End Products

An exemplary list of embodiments which may advantageously be produced using the material of the present invention includes X-ray tube insulators, apertures and enclosures; X-ray tube high-voltage insulators and enclosures; X-ray tube high voltage apertures; X-ray tube high voltage encapsulation devices; radioactive shielding containers; and other medical X-ray and gamma ray housings. Applicant produces X-ray tube enclosures and electrical insulators for high voltage ion implanters comprising about 30 percent bismuth oxide filled by volume (75% by weight) for commercial use, as well as similar X-ray tube enclosures and electrical insulators comprising about 20 percent bismuth oxide by volume (66% by weight) and about 27 percent barium sulfate by volume. These enclosures and insulators are rigid, self-supporting structures having wall thicknesses of at least 0.25 inches and diameters as large as 30 inches or more.

One such example is disclosed in detail below. Industrially, an exemplary list of embodiments in which the composition of the invention may advantageously be incorporated include ion source insulators for ion implantation machinery and other devices for insulating, isolating, directing or shielding any radiation producing device. As stated, these lists are exemplary only and embodiments of the invention may be utilized within the art field of radiation shielding in a broad range of equivalent ways.

One additional example embodiment of the device is depicted in the figures: an ion source high voltage insulator.

FIG. 1 is a perspective view of an embodiment of an ion source insulator according to the present invention. Ion source insulator 2 is generally annular in shape so as to allow to pass therethrough an ion implantation beam such as those used in the creation of microchip wafers. Such a device may advantageously have a desirable combination of radiation shielding ability, electrical resistivity, physical structural parameters and other characteristics as are allowed by use of the polymer-bismuth oxide composite of the present invention.

In use, the device may be placed directly against the ion source and/or may be placed around the ion stream at later points, for example, after magnetic devices which may focus, re-direct or otherwise alter the ion beam, or in any other location in which radiation or electrical charges may need to be blocked. Thus one, two or more mating surfaces may be used: vacuum sealing surfaces 10 are shown in the exemplary embodiment: smooth faces which allow tight seals. Alignment pin 20, one of several possible, may be used to assure proper alignment, the number and arrangement of pins obviously allows proper alignment to be assured in as many degrees of freedom as must be restricted. Metallic inserts 30 provide convenient anchors to the overall structure of the device into which the shield/insulator may fit. For example, inserts 30 may have internal threading so as to accept bolts. Such features may be produced by molding, inserts, machining, or other means suitable for use with polymer materials as are known in the art. One additional desirable quality is that these features may be created "on demand" as requested by end users of the item; this demonstrates the versatility of the composite taught by the invention.

Surface convolutions 40 may be seen to exist in this embodiment on both the outer surface of insulator and on the inner surface. In both locations and at other points of the manufacture, the fine granularity of the bismuth oxide composite allows for reliable manufacture without concern that geometries of lead oxide based devices must be altered to compensate for differing material properties.

While the exemplary ion source insulator is quite simple, such devices may be complex, having a much greater depth, having a much greater thickness, having multiple grooves and ridges and so on. Items created using the composite of the present invention need not be annular nor even circular but may be any shape as required. The range of sizes in such insulators is quite broad: from 1 inch to 20 or more inches tall, diameters from 6 to 100 inches, wall thicknesses which might be from ¼ inch thick up to 3 inches thick and weights anywhere from under 1 pound to over 500 pounds. Ion source insulators comprising 70% and 75% by weight bismuth are in commercial production.

Figure 2:
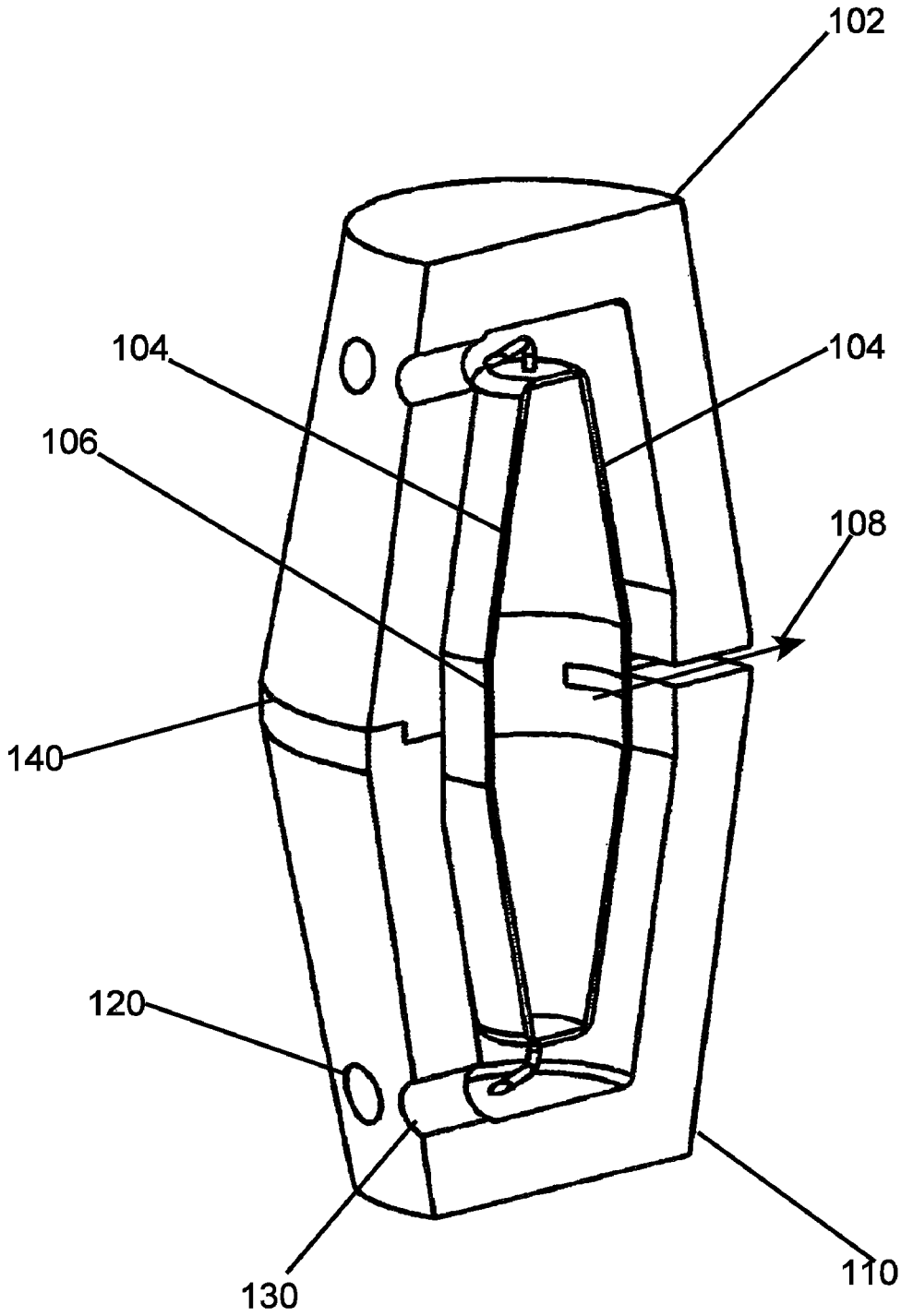
FIG. 2 is a cross-sectional perspective view of a second embodiment showing an X-ray tube "box" according to the present invention.

As another example, FIG. 2 teaches one example of an X-ray shielding "box." X-ray shielding insulators are used in an extremely wide range of shapes and sizes: cylinders, three dimensional conic sections, prisms, regular and irregular solids and composite shapes. A typical "box" might be irregular, 16 inches on a side and have a weight from 1 to 30 pounds. The thickness of the walls may be even greater than that of industrial ion source insulators.

The box 102 shown in cross-sectional perspective in FIG. 2 is a composite of two truncated conical sections, but is an example only. It contains X-ray tube 104, having plating 106 and emitting X-ray beam 108.

Box 102 has a number of features required to allow X-ray tube 104 to function properly. Obviously, box 102 has thick walls 110 of the desired composite material. As will be clear based upon the continents above, the desirable properties of bismuth oxide composites allow 2:1 replacement, in embodiments possibly 1:1 replacement, to make the box walls. Oil cooling port 120 and electrical port 130 allow oil and electrical connections to the interior of the box. Overlap joint 140 is designed to prevent radiation leakage from the joint during the case manufacture. Such details are made easier to implement based upon the demonstrated granularity benefits and the lack of regulation of bismuth oxide and bismuth compounds in general.

In short, regardless of shape or size of the item to be made the present invention may be adapted to any radioactive/ion/gamma ray/x-ray shielding application without undue experimentation and without departing from the scope of the invention. Formulations other than those specifically provided may be employed without departing from the scope of the invention.

Bismuth oxide filled products in accordance with the present invention have been chosen as production items in the ion implant and X-ray enclosure field because they provide a technological solution to a very complex problem. No other lead-free filled plastic material solves these problems.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

I claim:

1. A radiation shielding structure, the structure comprising:

a heavily filled material comprising:

a plastic polymer matrix; and at least about 66 percent by weight of a bismuth compound within the polymer matrix, wherein the bismuth compound comprises at least one member selected from the following group: bismuth oxide, bismuth aluminate, bismuth citrate, bismuth hydroxide, bismuth subgallate, bismuth subsalicylate, bismuth hydrate, bismuth subcarbonate, bismuth oxychloride, and combinations thereof;

wherein:

the material is rigid, self-supporting, and electrically insulating; and the structure is single-walled with a wall thickness of at least about 0.25 inches.

2. The rigid structure of claim 1, wherein the bismuth compound is present in an amount of at least about 70 percent by weight.

3. The rigid structure of claim 1, wherein the bismuth compound is present in an amount of at least about 75 percent by weight.

4. The rigid structure of claim 1, wherein the material has electromagnetic, alpha, and beta radiation shielding capability of the same order of magnitude as lead oxide filled epoxy.

5. The rigid structure of claim 1, wherein the material has properties selected from the following group: a dielectric strength greater than about 200 volts/mil; an arc resistance greater than about 100 seconds; a low thermal conductivity; and combinations thereof.

6. The rigid structure of claim 1, wherein the polymer matrix comprises at least one member selected from the following group: thermosetting materials, thermoplastic materials, and combinations thereof.

7. The rigid structure of claim 1, wherein the polymer matrix comprises at least one member selected from the following group: epoxy, polyester, polyurethane, silicone rubber, bismaleimides, polyimides, vinylesters, urethane hybrids, polyurea elastomer, phenolics, cyanates, cellulose, fluoro-polymer, ethylene inter-polymer alloy elastomer, ethylene vinyl acetate, nylon, polyetherimide, polyester elastomer, polyester sulfone, polyphenyl amide, polypropylene, polyvinylidene flouride, acrylic, homopolymers, acetates, copolymers, acrylonitrile-butadiene-styrene, fluoropolymers, ionimers, polyamides, polyamide-imides, polyacrylates, polyether ketones, polyaryl-sulfones, polybenzimidazoles, polycarbonates, polybutylene, terephthalates, polyether sulfones, thermoplastic polyimides, thermoplastic polyurethanes, polyphenylene sulfides, polyethylene, polypropylene, polysulfones, polyvinylchlorides, styrene acrylonitriles, polystyrenes, polyphenylene, ether blends, styrene maleic anhydrides, allyls, aminos, polyphenylene oxide, and combinations thereof.

8. The rigid structure of claim 1, further comprising a third material.

9. The rigid structure of claim 8, wherein the third material comprises at least one member selected from the following group: electrically insulating materials, binders, high density materials, and combinations thereof.

10. The rigid structure of claim 8, wherein the third material comprises at least one member selected from the following group: tungsten metal, other metals, calcium carbonate, hydrated alumina, tabular alumina, silica, glass beads, glass fibers, magnesium oxide/sulfate, wollastonite, stainless steel fibers, copper, carbonyl iron, iron, molybdenum, nickel, and combinations thereof.

11. The rigid structure of claim 8, wherein the third material comprises barium sulfate within the polymer matrix.

12. The rigid structure of claim 8, wherein the third material comprises an amount by volume approximately ranging from about 5 percent to about 35 percent of the total composite volume.

13. The rigid structure of claim 8, wherein the third material comprises an amount by volume approximately ranging from about 10 percent to about 30 percent of the total composite volume.

14. The rigid structure of claim 1, wherein the bismuth compound comprises bismuth oxide in an amount of at least about 66 percent by weight of the material.

15. The rigid structure of claim 1, wherein the bismuth compound comprises bismuth oxide in an amount of at least about 80 percent by weight of the material.

16. The rigid structure of claim 1, comprising:

a radiation shield box having a first truncated cone section and a second truncated cone section secured together at their respective bases by an overlap joint so as form a hollow structure, the first and second truncated cone sections having walls.

17. The radiation shield box of claim 16, further comprising an X-ray tube disposed within the hollow structure, at least one electrical port passing through the wall, and at least one oil port passing through the walls.

18. The rigid structure of claim 1, wherein:

the structure comprises a high voltage electrical insulator for an ion source, the insulator comprising a generally annular shaped structure having at least one vacuum sealing surface dimensioned and configured to provide a tight seal.

19. The rigid structure of claim 18, further comprising an element selected from at an alignment pin projecting from the insulator, a metal insert secured to the structure; and combinations thereof.

20. The high voltage electrical insulator for an ion source of claim 18, further comprising barium sulfate within the polymer matrix.

21. The high voltage electrical insulator of claim 18, wherein the polymer matrix comprises Novolac and at least about 10 percent by volume of hydrated alumina.

22. The high voltage electrical insulator of claim 18, further comprising at least about 16 percent hydrated alumina by volume within the matrix.

* * * * *

UNITED STATES PATENT AND TRADEMARK OFFICE

CERTIFICATE OF CORRECTION

PATENT NO. : 8,308,986 B1
APPLICATION NO. : 13/524447
DATED : November 13, 2012
INVENTOR(S) : Stuart McCord It is certified that error appears in the above-identified patent and that said Letters Patent is hereby corrected as shown below:

Title Page, Item (76) Inventor name should read Stuart McCord.

Signed and Sealed this
Twenty-second Day of January, 2013

David J. Kappos

David J. Kappos
*Director of the United States Patent and Trademark Office*